US005793267A

United States Patent [19]

Tada et al.

[11] Patent Number: 5,793,267

[45] Date of Patent: Aug. 11, 1998

[54] DIELECTRIC BLOCK FILTER HAVING FIRST AND SECOND RESONATOR ARRAYS COUPLED TOGETHER

[75] Inventors: Hitoshi Tada; Hideyuki Kato, both of Ishikawa-ken, Japan

[73] Assignee: Murata Manufacturing Co., Ltd., Japan

[21] Appl. No.: 612,090

[22] Filed: Mar. 7, 1996

[51] Int. Cl.[6] ..... H01P 1/205

[52] U.S. Cl. ..... 333/202; 333/206; 333/203

[58] Field of Search ..... 333/203, 206, 333/202

[56] References Cited

U.S. PATENT DOCUMENTS

| | | | |
|---|---|---|---|
| 4,431,977 | 2/1984 | Sokola et al. | 333/202 X |
| 5,191,305 | 3/1993 | Frost et al. | 333/206 X |
| 5,537,082 | 7/1996 | Tada et al. | 333/202 |

FOREIGN PATENT DOCUMENTS

| | | | |
|---|---|---|---|
| 213301 | 9/1987 | Japan | 333/202 DB |
| 53602 | 3/1989 | Japan | 333/202 DB |
| 11001 | 1/1990 | Japan | 333/202 DB |
| 92001 | 3/1990 | Japan | 333/206 |
| 4220001 | 8/1992 | Japan | 333/202 DB |
| 6006109 | 1/1994 | Japan | 333/202 DB |

*Primary Examiner*—Benny Lee

*Attorney, Agent, or Firm*—Ostrolenk, Faber, Gerb & Soffen, LLP

[57] ABSTRACT

In a dielectric filter comprising a dielectric block having outer conductors formed on the outer surfaces of the dielectric block, first and second arrays of through holes are formed in the dielectric block and have inner conductors formed on the inner surfaces thereof. A plurality of stages of dielectric resonators are constructed by the inner conductors formed in the through holes of the first array, the dielectric substance of the dielectric block and the outer conductors formed on the dielectric block, and the neighboring resonators of the first array are coupled to one another to form a band pass filter portion. Further, another plurality of stages of resonators are constructed by the inner conductors formed in the through holes of the second array, the dielectric substance of the dielectric block and the outer conductors formed on the dielectric block, and each of the resonators of the second array and those of the band pass filter portion are coupled to each other at each stage.

12 Claims, 15 Drawing Sheets

DIELECTRIC BLOCK FILTER HAVING FIRST AND SECOND RESONATOR ARRAYS COUPLED TOGETHER

BACKGROUND OF THE INVENTION

1. Field of the Invention

The present invention relates to a dielectric filter for use as a band block (cutoff) type filter using a block-shaped dielectric member.

2. Description of Related Art

FIG. 17 shows the structure of a conventional dielectric filter which is constructed having plural stages of resonators and is used as a band block type filter. In FIG. 17, the dielectric block 1 is designed in a rectangular parallelepiped shape, and three through holes 2 are formed in the dielectric block 1. Further, outer conductors 3 are formed on the outer surfaces thereof, and an inner conductor 4 is formed on the inner surface of each through hole 2. No outer conductor 3 is formed on a front surface of the dielectric block 1 as shown in FIG. 17 except for a part thereof. Coupling conductors 5 extend from the inner conductors 4. Three coupling conductors 6 which are capacitively coupled to the coupling conductors 5 are formed on the surface of the front surface, and conductors 7 for a signal transmission path are formed so that each of the conductors 7 is disposed between the neighboring pair of coupling conductors 6. The outer conductors 3 are formed on the five surfaces other than the front surface of the dielectric block 1 as shown in FIG. 17.

FIG. 18 is an equivalent circuit of the dielectric filter shown in FIG. 17. In FIG. 18, ZT represents the resonators which are formed in the dielectric block 1, and CT represents trap capacitance which is formed between the coupling conductors 5 and 6 shown in FIG. 17.

As described above, the neighboring resonators are coupled to each other with a phase difference of $\pi/2$ (rad) by using the transmission conductors 7 to form a band block type dielectric filter. FIG. 19 shows the characteristic of the dielectric filter shown in FIGS. 17 and 18. In FIG. 19, a graph representing attenuation (Att) vs. frequency (f), fo represents an operating frequency intended to be used, and this dielectric filter serves to block (cutoff) a frequency band below fo.

With respect to the conventional dielectric filter having the band block (cutoff) type characteristic as shown in FIG. 17, a unified dielectric filter can be fabricated by using a dielectric block having a relatively simple structure. However, the transmission conductors 7 for coupling the neighboring resonators with a phase difference of $\pi/2$ (rad) must be designed to be very long because this transmission path is a strip line which has one surface comprising the dielectric substance and another surface of air and thus the electrical length thereof is equal to or longer than the resonator length of the dielectric resonator. Therefore, the conventional dielectric filter has a problem in that the dimension thereof in an arrangement direction of the resonators is large. Further, an attenuation characteristic in a frequency band away from the operating frequency band (fo) is deteriorated as shown in FIG. 19, and particularly 2fo and 3fo cannot be attenuated. Therefore, the operating frequency fo may be adversely affected by a "spurious response" of a circuit disposed at a subsequent stage of the dielectric filter as described above.

SUMMARY OF THE INVENTION

An object of the present invention is to provide a dielectric filter which needs no transmission path conductor for coupling neighboring resonators with a predetermined phase difference, and whose dimension in the direction in which the resonators are arranged can readily be reduced.

Another object of the present invention is to provide a dielectric filter having an improved attenuation characteristic in a frequency band (particularly 2fo and 3fo) outside of an operating frequency band.

According to a first aspect of the present invention, in order to couple neighboring resonators with a phase difference of $\pi/2$ (rad) without using a conductor for providing a transmission path, a dielectric filter is formed having a dielectric block in which plural cavities are arranged, outer conductors formed at predetermined places on the outer surfaces of the dielectric block, and inner conductors formed in the cavities, characterized in that first and second cavity arrays are formed in the dielectric block with inner conductors formed on the inner surfaces thereof. Plural stages of dielectric resonators are constructed by the inner conductors formed in the first cavity array, the dielectric substance of the dielectric block and the outer conductors formed on the outer surfaces of the dielectric block, and the neighboring resonators are coupled to one another to form a band pass filter portion comprising the plural stages of resonators. Plural stages of resonators are also constructed by the inner conductors formed in the second cavity array, the dielectric substance of the dielectric block and the outer conductors formed on the outer surfaces of the dielectric block, and the resonators of the second cavity array and of the band pass filter portion are coupled to each other at each stage.

Further, according to a second aspect of the dielectric filter of the present invention, in order to set the resonator length of each resonator to substantially $\lambda/4$ and capacitively couple the resonators constituting the band pass filter portion, one opening portion of each cavity of the first cavity array is a short-circuit end while the other opening portion is an open end, a coupling conductor for capacitively coupling the neighboring resonators to each other is provided at the opening portion so that the plural stages of resonators are capacitively coupled to each other to form the band pass filter portion, and one opening portion of each cavity of the second cavity array is an open end while the other opening portion is a short-circuit end.

Further, according to a third aspect of the dielectric filter of the present invention, in order to set the resonator length of each resonator to substantially $\lambda/4$ and to combline-couple the resonators constituting the band pass filter portion to one another, one opening portion of each cavity of the first array is set as a short-circuit end, tip capacitance is formed between the outer conductors and the other opening portion or a neighboring portion thereof so that the plural stages of resonators are combline-coupled to one another to form the band pass filter portion, and one opening portion of each cavity of the second cavity array is an open end while the other opening portion is a short-circuit end.

Further, according to a fourth aspect of the dielectric filter of the present invention, in order to set the resonator length of each resonator to substantially $\pi/2$ and to combline-couple the resonators constituting the band pass filter portion to one another, one opening portion of each cavity of the first array is a short-circuit end, tip capacitance is formed between the outer conductors and the other opening portion or a neighboring portion thereof so that the plural stages of resonators are combline-coupled to one another to form the band pass filter portion, and both opening portions of each cavity of the second cavity array are open ends or short-circuit ends.

According to the dielectric filter of the first aspect of the present invention, the neighboring resonators of the plural dielectric resonators which are constructed by the inner conductors formed in the cavities of the first cavity array, the dielectric substance of the dielectric block and the outer conductors formed on the outer surfaces of the dielectric block, are coupled to each other to function as a band pass filter portion comprising plural stages of resonators. On the other hand, the inner conductors formed in the cavities of the second cavity array, the dielectric substance of the dielectric block and the outer conductors formed on the outer surfaces of the dielectric block function as plural resonators in combination with each other, and these resonators and the band pass filter portion are coupled to each other at each stage. With respect to the plural stages of resonators which constitute the band pass filter portion, the neighboring resonators are coupled to each other with a phase difference of $\pi/2$ (rad), so that the plural resonators constructed by the second cavity array are coupled to one another with a phase difference of $\pi/2$ (rad) through the resonators of the band pass filter portion, and these resonators function as a band block filter.

According to the dielectric filter of the second aspect of the present invention, each of the inner conductors formed in the first and second cavity arrays is designed so that one opening portion thereof is an open end while the other opening portion is a short-circuit end, so that it functions as a resonator having a resonator length of $\lambda/4$. The coupling conductor is provided at the open end of the inner conductor formed in each cavity of the first cavity array, and the neighboring resonators are capacitively coupled to each other, whereby the band pass filter portion is constructed.

According to the dielectric filter of the third aspect of the present invention, the inner conductors formed in the first and second cavity arrays function as the resonators having resonator length of $\lambda/4$ because one opening portions thereof are open ends and the other opening portions thereof are short-circuit ends, and further the resonators are comblinecoupled to each other to fabricate the band pass filter portion because the tip capacitance is formed between the opening portion of each cavity of the first cavity array or their neighboring portion and the outer conductor.

According to the dielectric filter of the fourth aspect of the present invention, the opening portion of each cavity of the first cavity array is an open end, and the tip capacitance is formed between the other opening portion or its neighboring portion and the outer conductor, so that each cavity functions as a resonator of length $\lambda/2$. These resonators are comblinecoupled to each other to thereby fabricate the band pass filter portion. Further, both the opening portions of each cavity of the second cavity array are open ends or short-circuit ends, so that each cavity functions as a resonator of $\lambda/2$ length, and each of these resonators and the band pass filter portion are coupled to each other at each stage. In the plural stages of resonators which constitute the band pass filter portion, the neighboring resonators are coupled to one another with a phase difference of $\pi/2$ (rad), so that the plural resonators based on the second cavity arrays are coupled to one another with a phase difference of $\pi/2$ (rad) through the resonators of the band pass filter portion, and they function as a band block type filter.

Other features and advantages of the present invention will become apparent from the following description of embodiments of the invention which refers to the accompanying drawings.

BRIEF DESCRIPTION OF THE DRAWINGS

FIG. 6 is a diagram showing the structure of a dielectric filter according to a fourth embodiment of the present invent on;

DETAILED DESCRIPTION OF EMBODIMENTS OF THE INVENTION

Figure 1A:
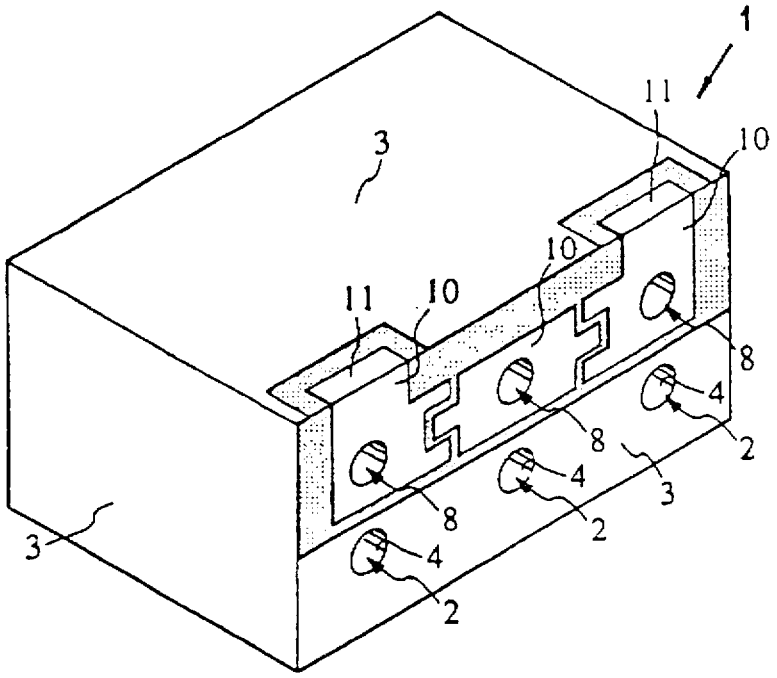
FIGS. 1A and 1B are perspective views showing the structure of a dielectric filter according to a first embodiment of the present invention.

Preferred embodiments according to the present invention will be described hereunder with reference to the accompanying drawings, in which like reference numerals indicate like elements and parts, such that each element and part does not need to be described in connection with each drawing in which it appears.

First, the structure of a dielectric filter according to a first embodiment will be described with reference to FIGS. 1A to 3B.

Figure 1B:
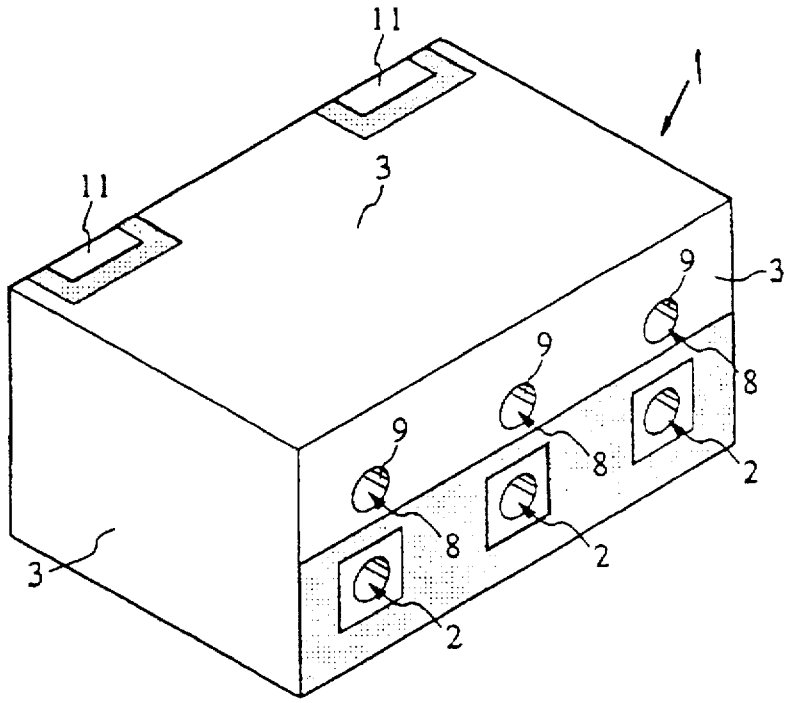

FIGS. 1A and 1B are perspective views of the dielectric filter of the first embodiment. FIG. 1B corresponds to a view which is taken diagonally from above the rear side of FIG. 1A. In FIGS. 1A and 1B, a dielectric block 1 is designed in a rectangular parallelepiped shape, and has six through holes 2, 8 which are formed therein so as to penetrate through the dielectric block 1 in the same axial direction. Further, the dielectric block 1 has outer conductors 3 at predetermined places on the outer surfaces thereof, and also has inner conductors 4 (see FIG. 1A) and 9 (see FIG. 1B) on the inner surfaces of the through holes 2 and 8, respectively.

The outer conductor 3 is formed on the lower front surface as shown in FIG. 1A so as to continuously extend from the inner conductors 4, and this portion is used as a short-circuit end. The surface which is opposite the short-circuit end of the inner conductors 4 is used as an open-circuit end as shown in FIG. 1B. Further, the outer conductor 3 is also formed on the upper front surface as shown in FIG. 1B so as to continuously extend from the inner conductors 9, and this portion is used as a short-circuit end. Coupling conductors 10 (see FIG. 1B) which continuously extend from the inner conductors 9 are formed on the surface which confronts the short-circuit end of the inner conductors 9 (the partial front surface as shown in FIG. 1A). These coupling conductors 10 form electric capacitance between the neighboring coupling conductors. Further, input/output conductors 11 are formed on the upper surface of the dielectric block of FIGS. 1A and 1B so as to continuously extend from the coupling conductors 10.

When the dielectric filter as described above is mounted on a circuit board, the dielectric filter is mounted on the surface of the circuit board with the upper surface of the dielectric filter facing the circuit board. At this time, the outer conductor 3 on the upper surface of the dielectric filter is electrically connected to a ground electrode, etc., on the circuit board, and the input/output conductors 11 are electrically connected to a conductor pattern on the circuit board.

Figure 2:
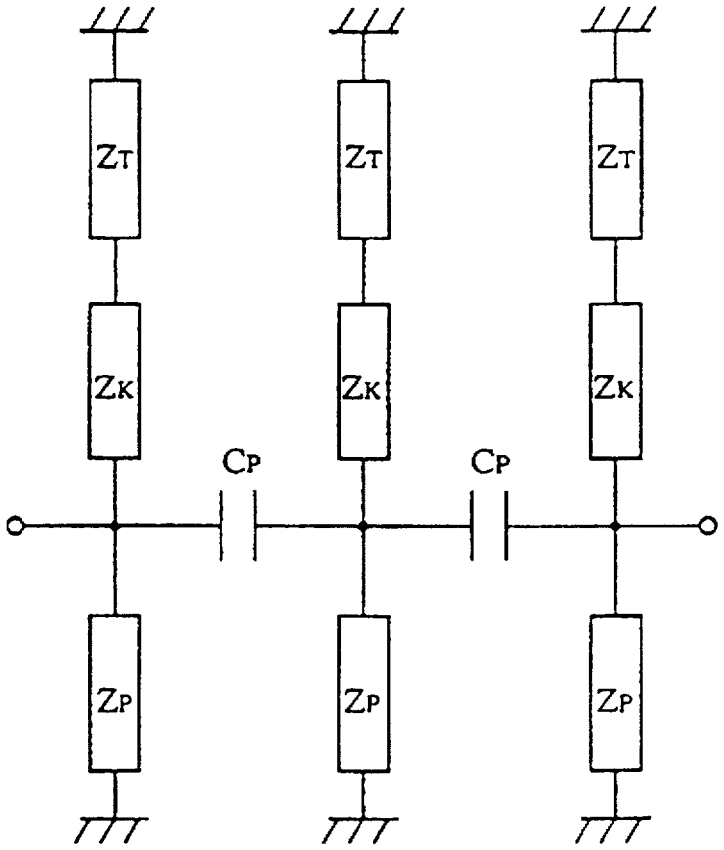
FIG. 2 is an equivalent circuit diagram showing the dielectric filter of the first embodiment.

FIG. 2 is an equivalent circuit diagram of the dielectric filter shown in FIGS. 1A and 1B. Here, ZP represents resonators which are constructed by the inner conductors 9 formed in the through holes 8, the dielectric substance of the dielectric block 1 and the outer conductors 3 shown in FIGS. 1A and 1B. CP represents the electrostatic capacitance which is formed between the coupling conductors 10. ZT represents resonators which are constructed by the inner conductors 4 formed on the inner surfaces of the through holes 2, the dielectric substance of the dielectric block 1 and the outer conductors 3 as shown in FIGS. 1A and 1B. ZK represents mutual impedance between the resonator ZT and the dielectric resonator ZP which constitutes a band pass filter portion. As described above, the resonators ZT are coupled to one another through the mutual impedance ZK and the resonators ZP of the band pass filter.

Figure 3A:
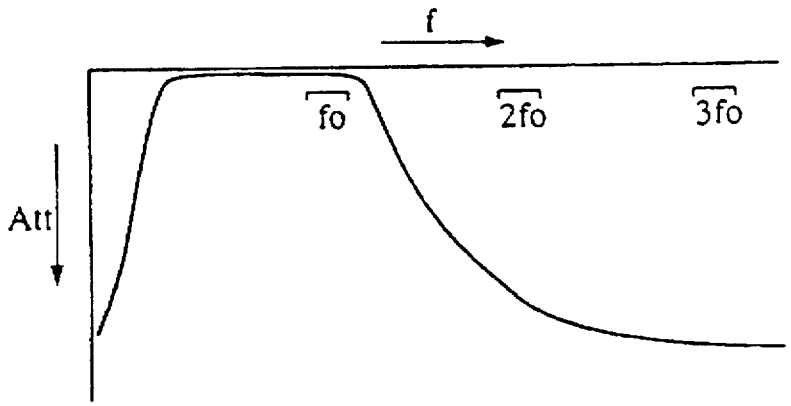
FIGS. 3A and 3B are characteristic diagrams showing the dielectric filter of the first embodiment.
Figure 3B:
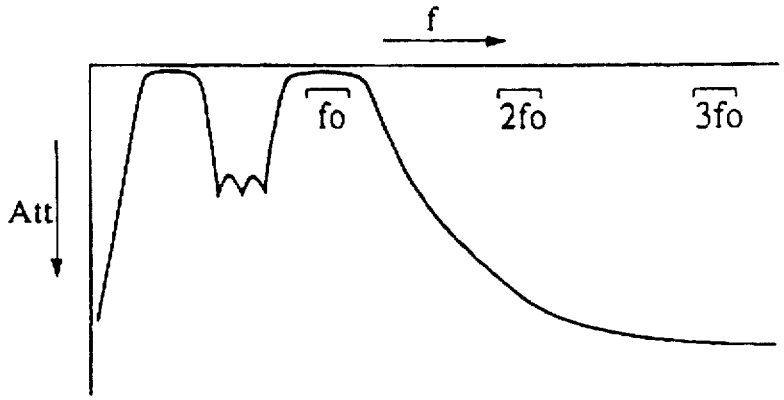

FIGS. 3A and 3B are characteristic diagrams (attenuation (Att) vs. frequency (f)) of the dielectric filter shown in FIG. 1. FIG. 3A shows the characteristic of only the band pass filter portion, and FIG. 3B shows the entire characteristic of the dielectric filter. The entire characteristic of the dielectric filter corresponds to the superposition of the characteristic of the band pass filter portion and the characteristic of the band block filter. As described above, the operating frequency band fo is passed while lower frequencies are attenuated, and higher frequencies such as 2fo, 3fo, etc., are also attenuated by using the characteristic of the band pass filter portion.

Figure 4A:
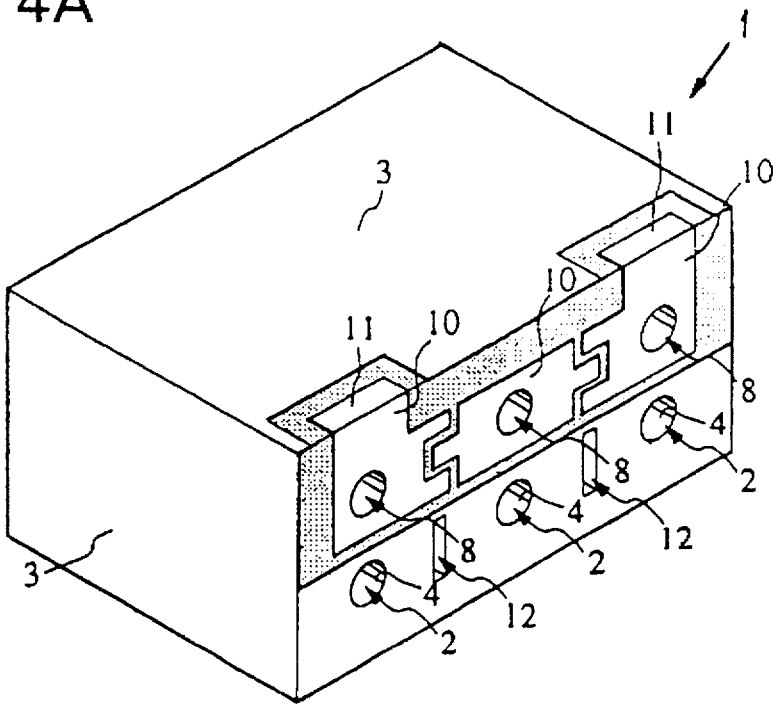
FIGS. 4A and 4B are perspective views showing a dielectric filter according to a second embodiment of the present invention.
Figure 4B:
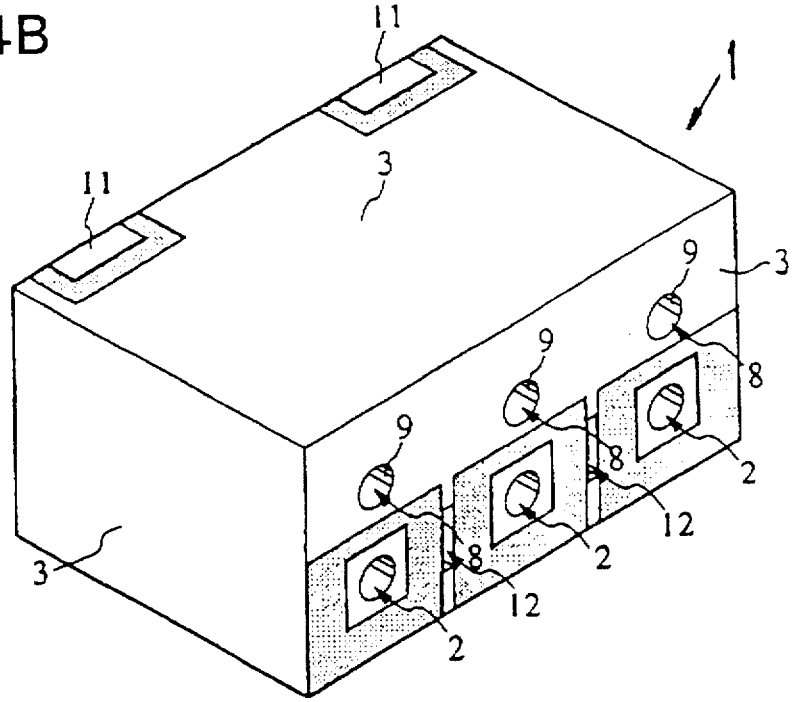

Next, FIGS. 4A and 4B show the structure of a dielectric filter according to a second embodiment. This embodiment is different from the embodiment shown in FIGS. 1A and 1B in that holes 12 are formed between each adjacent pair of the three through holes 2. Conductors which are continuously extended from the outer conductors 3 are formed on the inner surfaces of the holes 12. Accordingly, the three resonators which are constructed by the through holes 2 are hardly coupled to one another, so that the attenuation pole of the band block filter and the resonance frequency are in one-to-one correspondence relationship and thus the adjustment of the characteristic can be easily performed. Next, the structure of a dielectric filter 1 according to a third embodiment of the present invention will be described with reference to FIG. 5. The perspective view of the dielectric filter 1 of the third embodiment is identical to that of FIGS. 1A and 1B.

Figure 5:
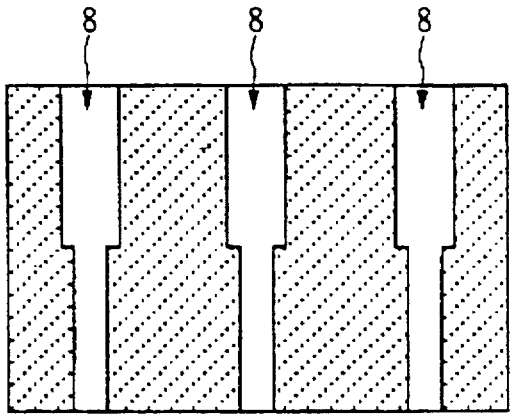
FIG. 5 is a diagram showing the structure of a dielectric filter according to a third embodiment of the present invention.

FIG. 5 is a cross-sectional view which is taken along a plane which passes the center portions of the three through holes 8 shown in FIGS. 1A and 1B in the axial direction thereof. As shown in FIG. 5, the through holes 8 are designed in a stepwise structure so as to have a small inner diameter at the short-circuit end and a large inner diameter at the open-circuit end. With this structure, the resonator impedance at the open-circuit end is smaller than the resonator impedance at the short-circuit end, and the entire resonator length is shortened, so that the dimension of the through holes in the axial direction can be reduced.

Figure 6:
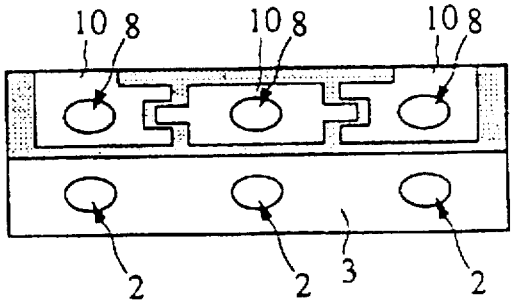

FIG. 6 shows the structure of a dielectric filter 1 according to a fourth embodiment of the present invention having through holes 2, 8, outer conductors 3, and coupling conductors 10 similar to those in FIGS. 1A to 1B. FIG. 6 is a front view which is taken from the side of one opening end of each through hole 2, 8. The overall structure of the filter is similar to that of FIGS. 1A and 1B. However, in this embodiment, each through hole 2, 8 is designed to have a laterally elongated circular (elliptical) sectional shape as shown in FIG. 6, whereby the dimension of the dielectric filter in the height direction can be reduced.

Figure 7A:
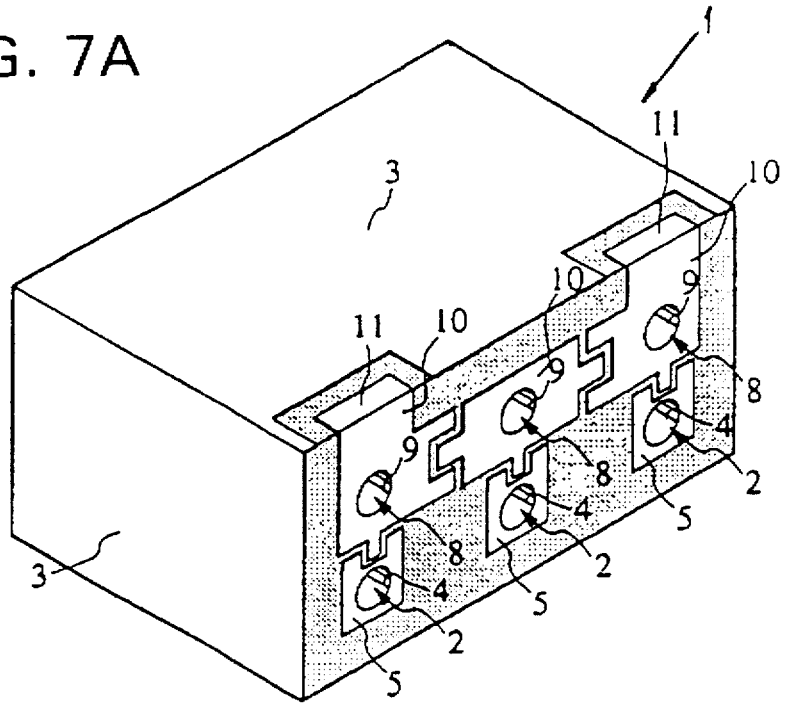
FIGS. 7A and 7B are perspective views showing the structure of a dielectric filter according to a fifth embodiment of the present invention.
Figure 7B:
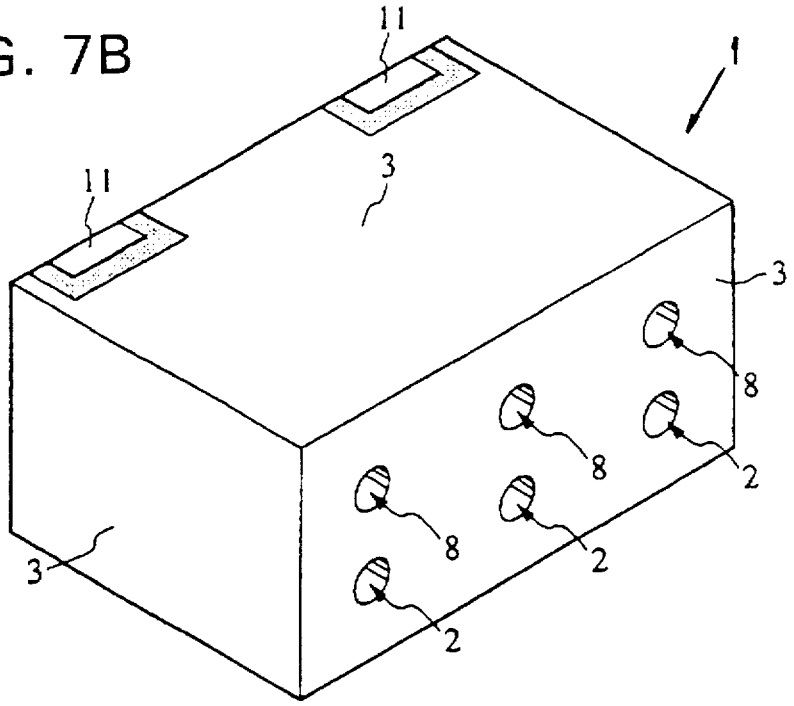

FIGS. 7A and 7B show the structure of a dielectric filter according to a fifth embodiment.

FIGS. 7A and 7B are perspective views of the dielectric filter, and FIG. 7B corresponds to a view which is taken diagonally from above the rear side of FIG. 7A. In FIGS. 7A and 7B, a dielectric block 1 is designed in a rectangular parallelepiped shape, and has six through holes 2 and 8 which are formed therein so as to penetrate through the dielectric block 1 in the same axial direction. Outer conductors 3 are formed at predetermined places on the outer surfaces of the dielectric block 1, and inner conductors 4 and 9 are formed on the inner surfaces of the through holes 2 and 8 as shown in FIG. 7A. Coupling conductors 5 which continuously extend from the inner conductors 4 and coupling conductors 10 which continuously extend from the inner conductors 9 are formed on the front surface as shown in FIG. 7A. With this structure, electrostatic capacitance is formed within each stage between the coupling conductor 5 and the coupling conductor 10, and at the same time electrostatic capacitance is also formed between the neighboring coupling conductors 10 of the respective stages. Further, input/output conductors 11 which continuously extend from the coupling conductors 10 are formed on the upper surface of the dielectric block 1 as shown in FIGS. 7A and 7B, and an outer conductor 3 which continuously extends from the inner conductors 4 and 9 is formed on the front surface as shown in FIG. 7B. This portion is used as a short-circuit end.

Figure 8:
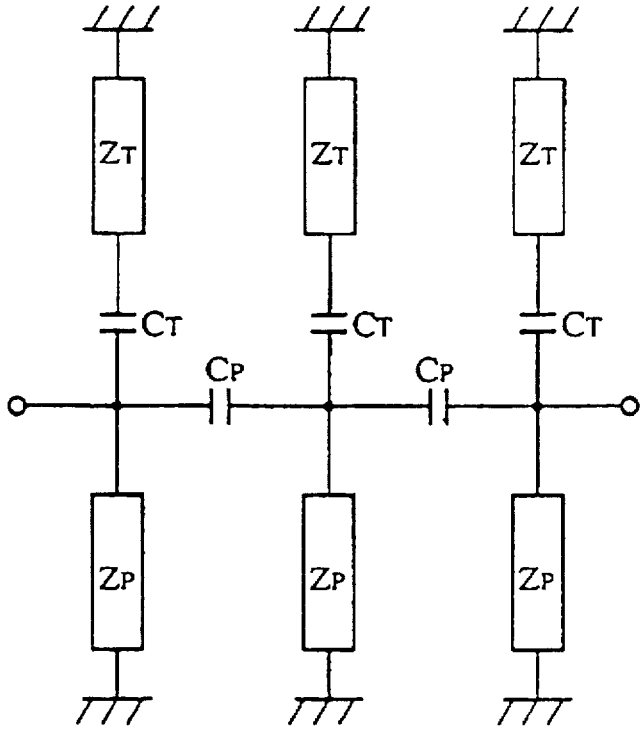
FIG. 8 is an equivalent circuit diagram for the dielectric filter according to the fifth embodiment.

FIG. 8 is an equivalent circuit diagram of the dielectric filter shown in FIGS. 7A and 7B. Here, ZP represents resonators constructed by the inner conductors 9 formed in the through holes 8, the dielectric substance of the dielectric block 1 and the outer conductor 3 as shown in FIGS. 7A and 7B. CP represents an electrostatic capacitance which is formed between the neighboring coupling conductors 10. CT represents electrostatic capacitance which is formed between the coupling conductors 5 and 10. ZT represents resonators which are constructed by the inner conductors 4 formed on the inner surfaces of the through holes 2, the dielectric substance of the dielectric block 1 and the outer conductor 3 as shown in FIGS. 7A and 7B. These three resonators ZT are coupled to one another through the band pass filter portion comprising the three resonators ZP with a phase difference of $\pi/2$ (rad) to obtain a dielectric filter serving as a band block filter. The characteristic of this filter is substantially similar to that of FIG. 3B.

Figure 9A:
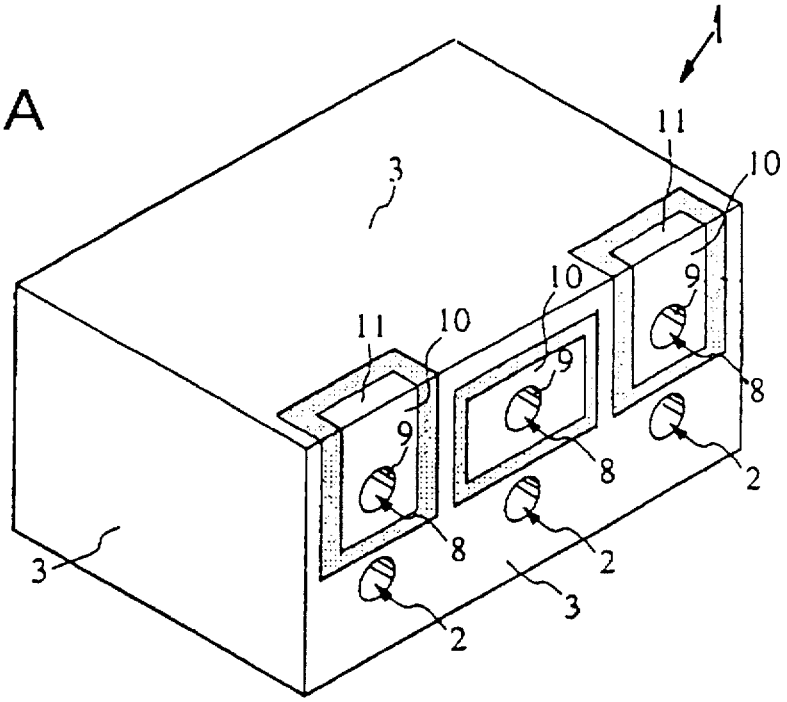
FIGS. 9A and 9B are perspective views showing the structure of a dielectric filter according to a sixth embodiment of the present invention.
Figure 9B:
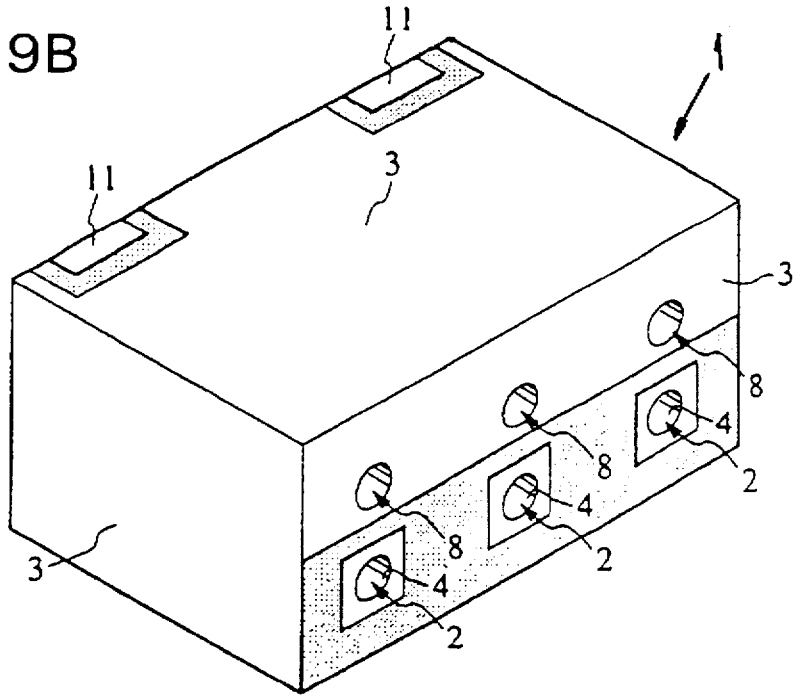

FIGS. 9A and 9B show the structure of a dielectric filter of a sixth embodiment according to the present invention.

FIGS. 9A and 9B are perspective views of the dielectric filter of the sixth embodiment. FIG. 9B corresponds to a view which is taken diagonally from above the rear side of FIG. 9A. In FIGS. 9A and 9B, the dielectric block 1 is designed in a rectangular parallelepiped shape, and has six through holes 2, 8 which are formed therein so as to penetrate through the dielectric block 1 in the same axial direction. Further, the dielectric block 1 has an outer conductor 3 at predetermined places on the outer surfaces thereof, and also has inner conductors 4 (see FIG. 9A) and 9 (see FIG. 9B) on the inner surfaces of the through holes 2 and 8, respectively. The outer conductor 3 is formed on the front side surface as shown in FIG. 9A so as to continuously extend from the inner conductors 4, and this portion is used as a short-circuit end. The surface opposite to the short-circuit end of the inner conductors 4 is used as an open end as shown in FIG. 9B. Further, coupling conductors 10 which continuously extend from the inner conductors 9 are formed on the front surface as shown in FIG. 9A. The outer conductor 3 continuously extends from the inner conductors 9 on the surface which is opposite the above surface, and this portion is used as a short-circuit end.

Further, input/output conductors 11 are formed on the upper surface of the dielectric block so as to continuously extend from the coupling conductors 10. With this structure, tip capacitance is produced between the outer conductor 3 and the coupling conductors 10 which continuously extend from the inner conductors 9 in the through holes 8, and the three resonators are combline-coupled to one another.

Figure 10:
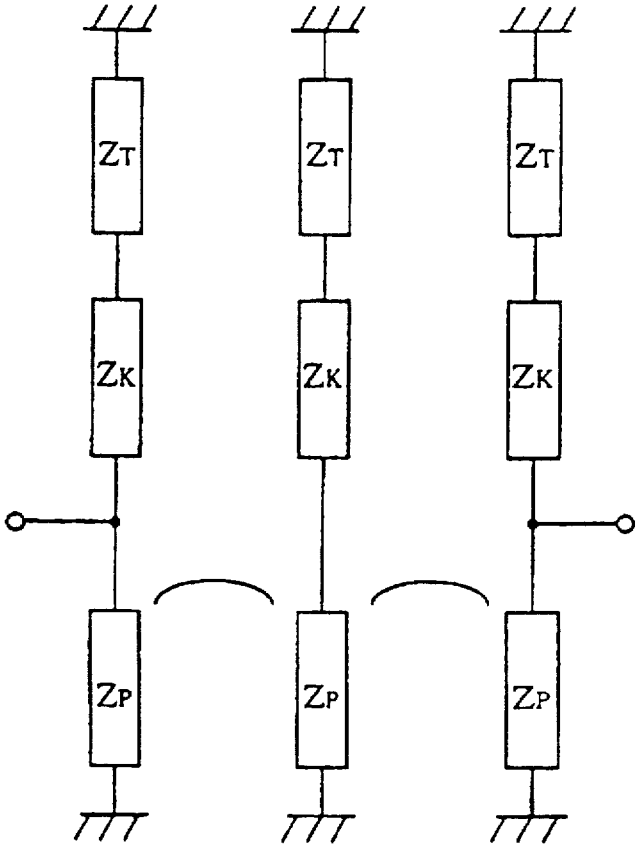
FIG. 10 is an equivalent circuit diagram for the dielectric filter according to the sixth embodiment.

FIG. 10 is an equivalent circuit diagram of the dielectric filter shown in FIGS. 9A and 9B. Here, ZP represents resonators which are constructed by the inner conductors 9 formed on the through holes 8, the dielectric substance of the dielectric block 1 and the outer conductor 3 shown in FIGS. 9A and 9B. ZT represents resonators which are constructed by the inner conductors 4 formed on the inner surfaces of the through holes 2, the dielectric substance of the dielectric block 1 and the outer conductor 3 as shown in FIGS. 9A and 9B. ZK represents mutual impedance between the resonator ZT and the dielectric resonator ZP which constitutes a band pass filter portion. As described above, the resonators ZT are coupled to one another through the mutual impedance ZK and the resonators ZP constituting the band pass filter portion. Accordingly, the three resonators ZT are coupled to one another with a phase difference of $\pi/2$ (rad) through the band pass filter portion, whereby the dielectric filter functioning as a band block filter is obtained.

Figure 11A:
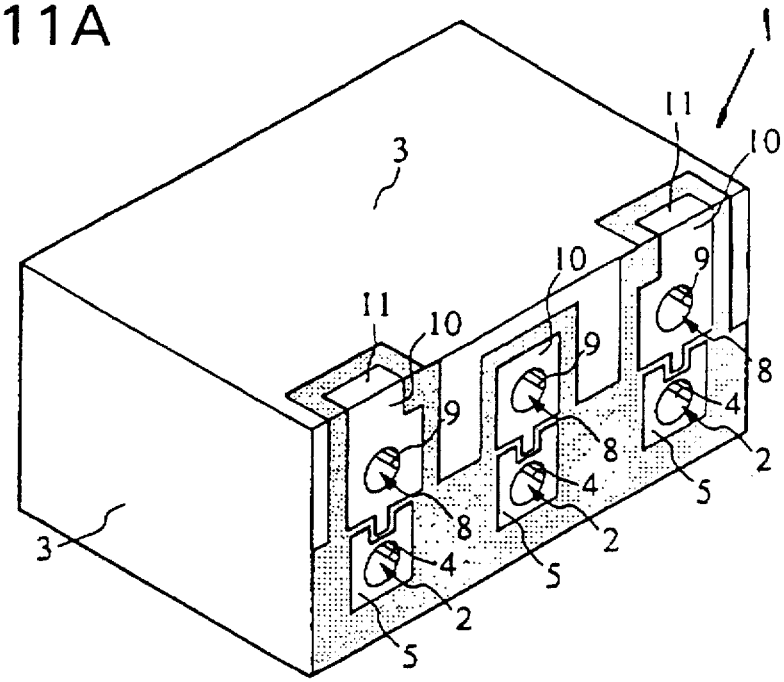
FIGS. 11A and 11B are perspective views showing the structure of a dielectric filter according to a seventh embodiment of the present invention.
Figure 11B:
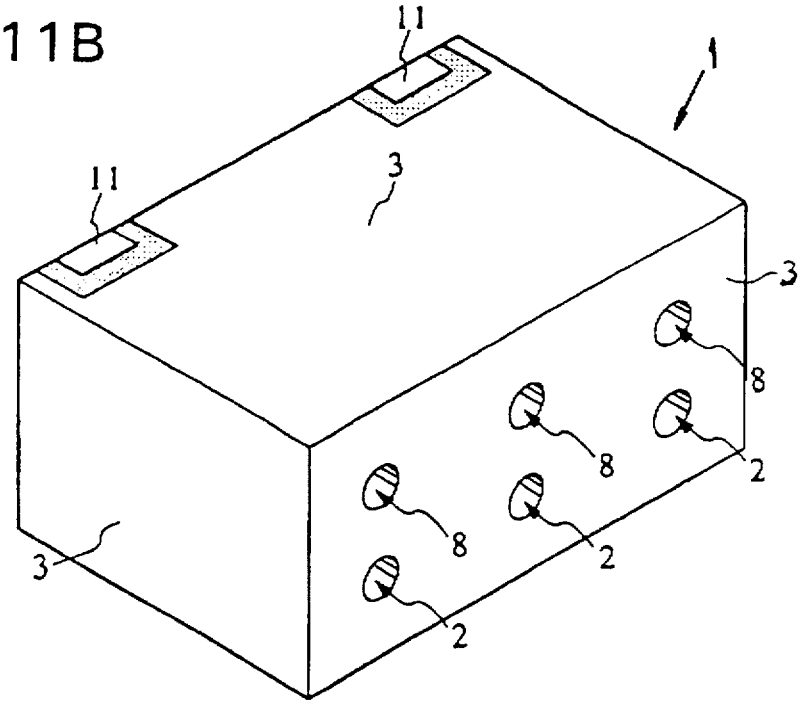

FIGS. 11A and 11B shows the construction of a dielectric filter according to a seventh embodiment.

FIGS. 11A and 11B are perspective views of the dielectric filter of the seventh embodiment. FIG. 11B corresponds to a view which is taken diagonally from above the rear side of FIG. 11A. In FIGS. 11A and 11B, the dielectric block 1 is designed in a rectangular parallelepiped shape, and has six through holes 2, 8 which are formed therein so as to penetrate through the dielectric block 1 in the same axial direction. Further, the dielectric block 1 has an outer conductor 3 at predetermined places on the outer surfaces thereof, and also has inner conductors 4 and 9 on the inner surfaces of the through holes 2 and 8, respectively, as shown in FIG. 11A.

Further, coupling conductors 5 which continuously extend from the inner conductors 4 and coupling conductors which continuously extend from the inner conductors 9 are formed on the front side surface as shown in FIG. 11A. With this structure, electrostatic capacitance is formed at each stage between the coupling conductors 5 and 10 (see FIG. 11A). Further, input/output conductors 11 which continuously extend from the coupling conductors 10 are formed on the upper surface in FIGS. 11A and 11B. The outer conductor 3 continuously extends from the inner conductors 4 and 9 on the front surface as shown in FIG. 11B, and this portion is used as a short-circuit end.

Figure 12:
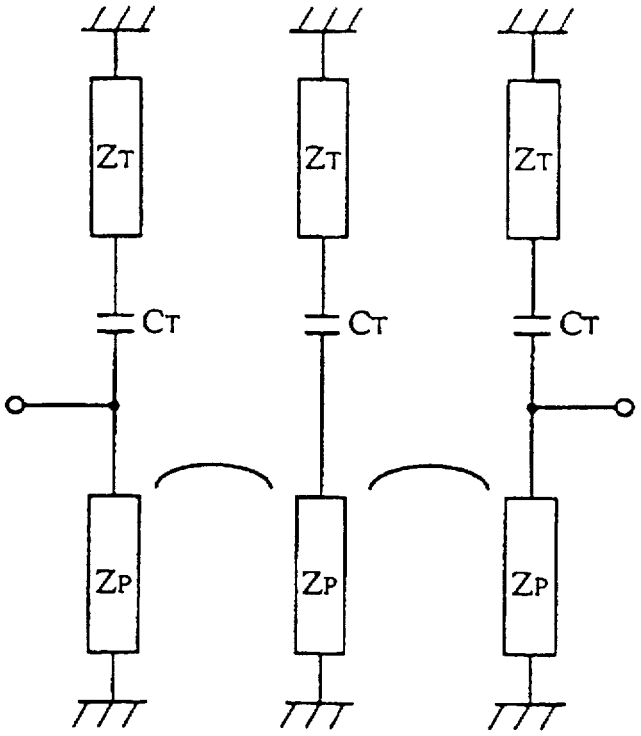
FIG. 12 is an equivalent circuit diagram of the dielectric filter according to the seventh embodiment.

FIG. 12 is an equivalent circuit diagram of the dielectric filter shown in FIGS. 11A and 11B. Here, ZP represents resonators which are constructed by the inner conductors 9 formed in the through holes 8, the dielectric substance of the dielectric block 1 and the outer conductor 3 shown in FIGS. 11A and 11B, and CT represents the electrostatic capacitor formed between the coupling conductors 5 and 10. ZT represents resonators which are constructed by the inner conductors 4 formed in the inner surfaces of the through holes 2, the dielectric substance of the dielectric block 1 and the outer conductors 3 as shown in FIGS. 11A and 11B, as described above. Accordingly, the three resonators ZT are coupled to one another with a phase difference of $\pi/2$ (rad) through the band pass filter portion comprising the three resonators ZP, whereby the dielectric filter functioning as a band block filter is obtained.

Figure 13A:
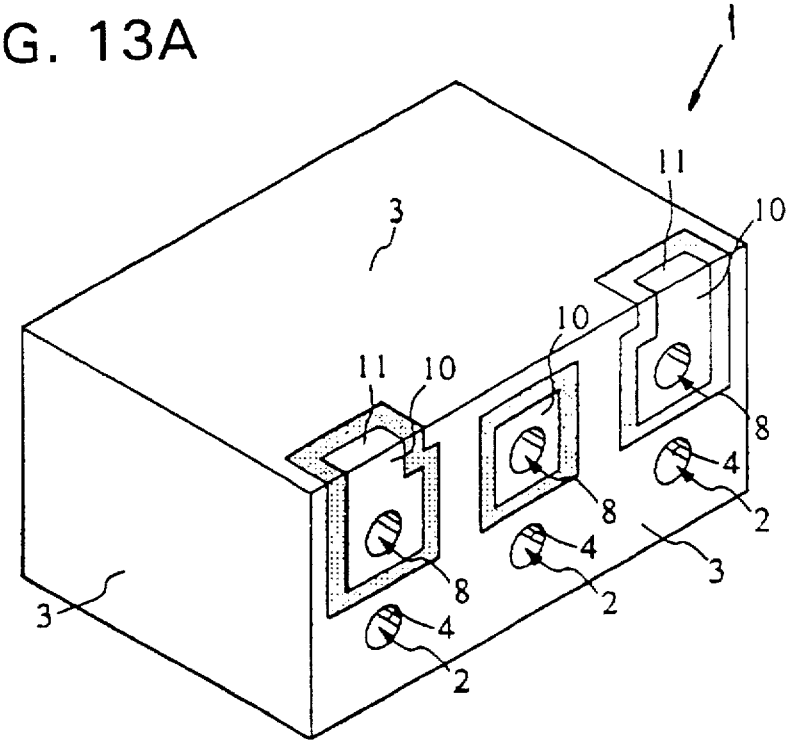
FIGS. 13A and 13B are perspective views showing the structure of a dielectric filter according to an eighth embodiment of the present invention.
Figure 13B:
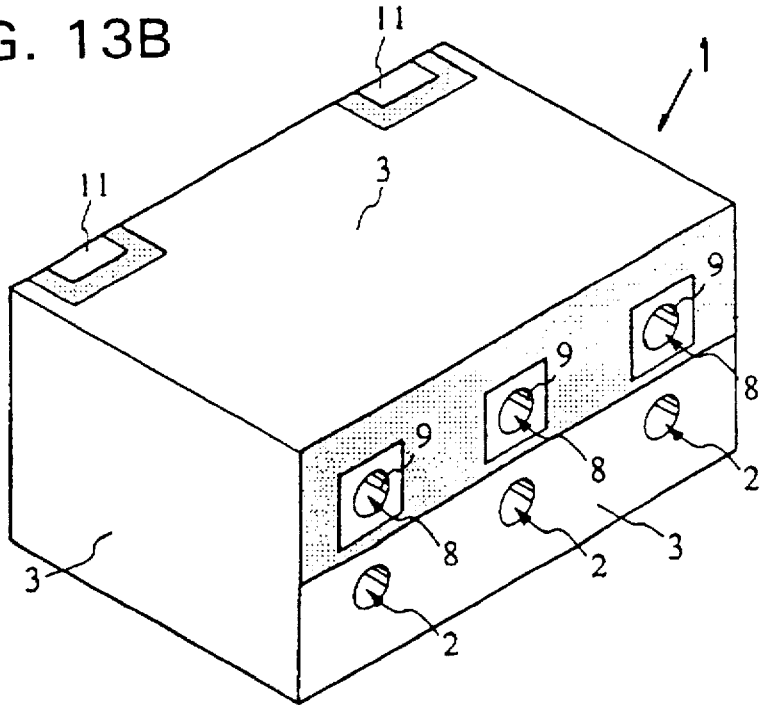

FIGS. 13A and 13B show the structure of the dielectric filter according to an eighth embodiment of the present invention.

FIGS. 13A and 13B are perspective views of the dielectric filter of the eighth embodiment, and FIG. 13B corresponds to a view which is taken diagonally from above the rear side of FIG. 13A. The dielectric block 1 of FIG. 13 is designed in a rectangular parallelepiped shape, and has six through holes 2 and 8 which are formed therein so as to penetrate through the dielectric block 1 in the same axial direction. Outer conductors 3 are formed at predetermined places on the outer surfaces of the dielectric block 1, and inner conductors 4 and 9 (see FIG. 13B) are formed on the inner surfaces of the through holes 2 and 8. As shown in FIGS. 13A and 13B, both ends of the inner. conductors 4 are used as short-circuit ends. Coupling conductors 10 which continuously extend from the conductors 9 are formed on the front surface shown in FIG. 13A, and the surface opposite the above surface is used as an open end. Further, input/output conductors 11 which continuously extend from the coupling conductors 10 are formed on the upper surface of the dielectric block as shown in FIGS. 13A and 13B. With this structure, tip capacitance is formed between the coupling conductors 10 and the outer conductors 3, and the three resonators are combline-coupled to one another by the tip capacitance.

Figure 14:
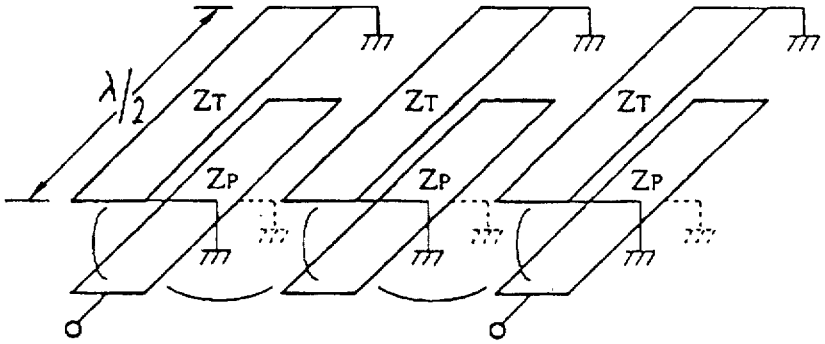
FIG. 14 is an equivalent circuit diagram showing the dielectric filter of the eighth embodiment.

FIG. 14 is an equivalent circuit diagram of the dielectric filter shown in FIGS. 13A and 13B. Here, ZP represents a resonator having a resonator length of $\pi/2$ which is constructed by the inner conductors 9 formed in the through holes 8, the dielectric substance of the dielectric block 1 and the outer conductor 3 shown in FIGS. 13A and 13B, and ZT represents a resonator having an electrical length of $\lambda/2$ which is constructed by the inner conductors 4 formed on the inner surfaces of the through holes 2, the dielectric substance of the dielectric block 1 and the outer conductor 3. As described above, the three resonators ZT are coupled to one another with a phase difference of $\pi/2$ (rad) through the band pass filter comprising the three resonators ZP to obtain a dielectric filter functioning as a band block filter.

Figure 15A:
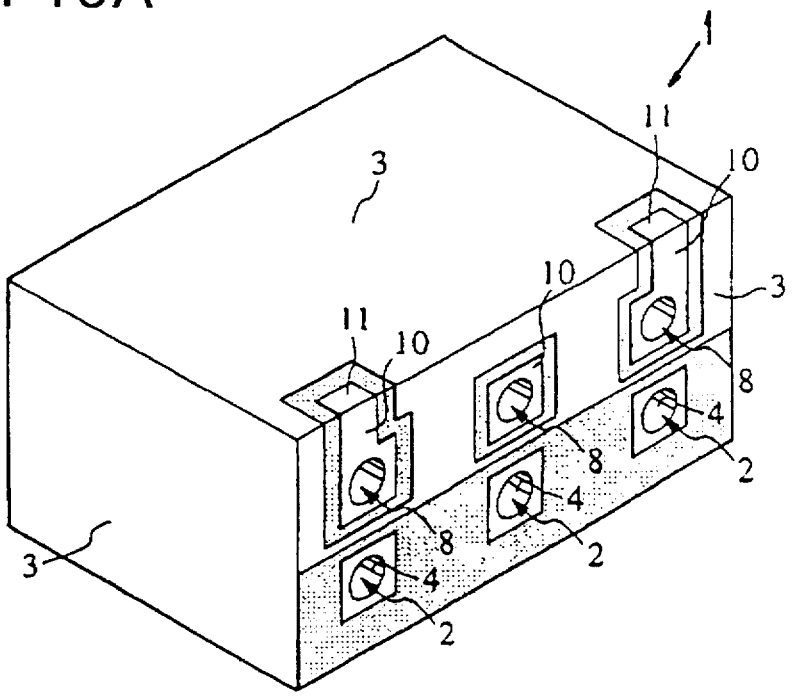
FIGS. 15A and 15B are perspective views showing the structure dielectric filter according to a ninth embodiment of the present invention.
Figure 15B:
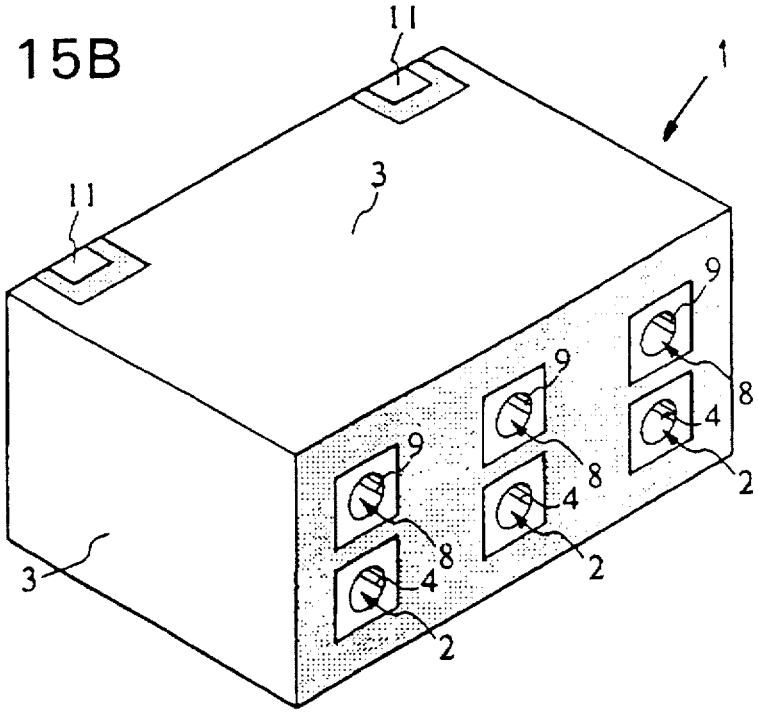
Figure 18:
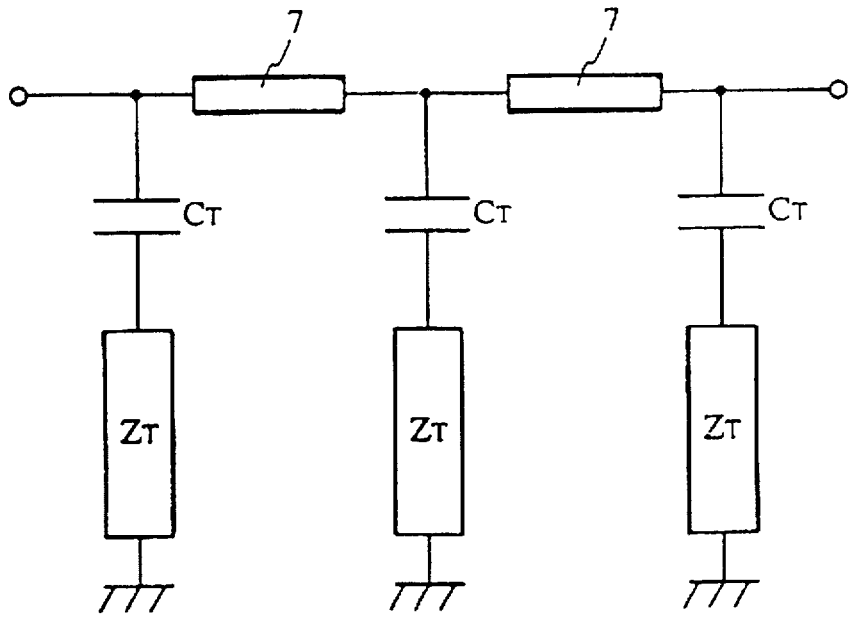
FIG. 18 PRIOR ART
FIG. 18 is an equivalent circuit diagram showing the dielectric filter shown in FIG. 17.
Figure 19:
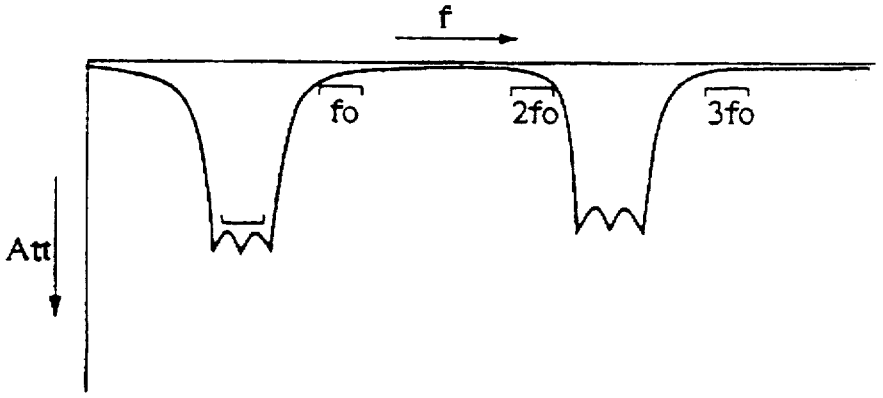
FIG. 19 PRIOR ART
FIG. 19 is a characteristic diagram showing the dielectric filter shown in FIG. 17.

FIGS. 15A and 15B show the structure of a dielectric filter according to a ninth embodiment of the present invention.

FIGS. 15A and 15B are perspective views of the dielectric filter, and FIG. 15B corresponds to a view which is taken diagonally from above the rear side of FIG. 15A. In FIGS. 15A and 15B, a dielectric block 1 is designed in a rectangular parallelepiped shape, and has six through holes 2 and 8 which are formed therein so as to penetrate through the dielectric block 1 in the same axial direction. Outer conductors 3 are formed at predetermined places on the outer surfaces of the dielectric block 1, and inner conductors 4 and 9 (see FIG. 15B) are formed on the inner surfaces of the through holes 2 and 8. As shown in FIGS. 15A and 15B, both ends of the inner conductors 4 are used as open ends. Coupling conductors 10 which continuously extend from the conductors 9 are formed on the front surface shown in FIG. 15A. Further, input/output conductors 11 which continuously extend from the coupling conductors 10 are formed on the upper surface of the dielectric block as shown in FIGS. 15A and 15B. With this structure, tip capacitance occurs between the coupling conductors 10 and the outer conductors 3, and the three resonators are combline-coupled to one another by the tip capacitance.

Figure 16:
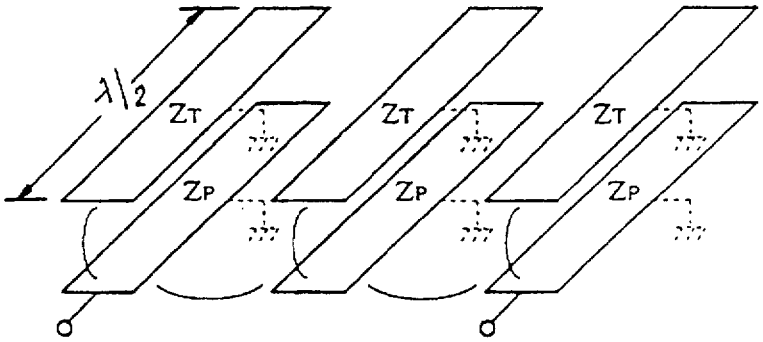
FIG. 16 is an equivalent circuit diagram showing the dielectric filter according to the ninth embodiment of the present invention.
Figure 17:
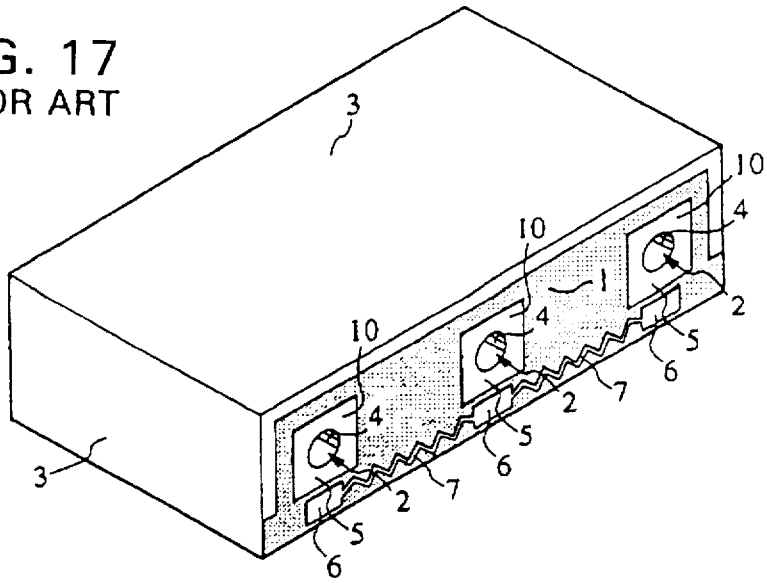
FIG. 17 PRIOR ART
FIG. 17 is a perspective view showing the structure of a conventional dielectric filter.

FIG. 16 is an equivalent circuit diagram of the dielectric filter shown in FIGS. 15A and 15B. Here, ZP represents a resonator having a resonator length of $\pi/2$ which is constructed by the inner conductors 9 formed in the through holes 8, the dielectric substance of the dielectric block 1 and the outer conductor 3 shown in FIGS. 15A and 15B, and ZT represents a resonator having an electrical length of $\lambda/2$ which is constructed by the inner conductors 4 formed on the inner surfaces of the through holes 2, the dielectric substance of the dielectric block 1 and the outer conductor 3. As described above, the three resonators ZT are coupled to one another with a phase difference of $\pi/2$ (rad) through the band pass filter comprising the three resonators ZP to obtain a dielectric filter functioning as a band block filter.

In each of the embodiments as described above, the cavities are formed in through holes which are formed in a single dielectric block. However, the dielectric block having plural cavities therein may also be formed by laminating plural dielectric plates each having grooves.

According to the above-described embodiments of the dielectric filter of the present invention, there is formed a multistage band pass filter portion comprising a plurality of resonators in which the neighboring resonators are coupled to each other, and another plurality of resonators are also constructed, and these other resonators and the band pass filter portion are coupled to each other at each stage, whereby the dielectric filter can function as a band block type filter as a whole. Therefore, it is unnecessary to provide conductors for a transmission path which have been conventionally used to couple the neighboring resonators with a predetermined phase difference, and thus the dimension of the dielectric filter in the arrangement direction of the resonators can be reduced. Further, bands outside the operating band, in addition to the blocked or cut-off band, are also attenuated due to the characteristic of the band pass filter, so that the adverse effect of the "spurious response" of a circuit at a stage subsequent to the dielectric filter can be sufficiently suppressed.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric filter having a dielectric block in which a plurality of cavities are arranged extending through said block, some of said cavities arranged into a first cavity array and the remaining ones of said cavities arranged into a second cavity array, an outer conductor disposed at predetermined places on outer surfaces of the dielectric block, and inner conductors respectively disposed on surfaces of the corresponding cavities so as to define a corresponding plurality of dielectric resonators associated with the first cavity array and the second cavity array, respectively;

said dielectric resonators of said first cavity array being coupled to one another to define a band pass filter portion comprising said plurality of resonators of said first cavity array; and a second plurality of stages of resonators are defined by said resonators of said second cavity array;

respective ones of said resonators of said second cavity array and said band pass filter portion being coupled to each other;

a first opening portion of each inner conductor of said first cavity array being electrically short-circuited to said outer conductor while a second opening portion thereof is electrically open-circuited;

a coupling conductor for capacitively coupling adjacent pairs of resonators of said first cavity array to each other being provided at each said second opening portion thereof so that said plurality of resonators are capacitively coupled to each other to define said band pass filter portion; and first opening portion of each inner conductor of said second cavity array being electrically open-circuited while a second opening portion thereof is electrically short-circuit to said outer conductor;

wherein said open-circuited first opening portions of said resonators of said first cavity array are at an end of said dielectric block and said short-circuited first opening portions of said resonators of said second cavity array are also at said end.

2. The dielectric filter as claimed in claim 1, wherein each of said resonators of said second cavity array has a respective cross-sectional shape which is elongated in a plane defined by said second cavity array.

3. The dielectric filter as claimed in claim 1, wherein each of said resonators of said first cavity array has a respective cross-sectional diameter at one of said first and second opening portions which is greater than a respective cross-sectional diameter at the other of said first and second opening portions.

4. The dielectric filter as claimed in claim 3, wherein each said greater cross-sectional diameter is at a respective said open-circuited first opening portion.

5. The dielectric filter as claimed in claim 1, wherein each of said resonators of said first cavity array has a respective cross-sectional shape which is elongated in a plane defined by said first cavity array.

6. The dielectric filter as claimed in claim 5, wherein each of said resonators of said second cavity array has a respective cross-sectional shape which is elongated in a plane defined by said second cavity array.

7. A dielectric filter having a dielectric block in which a plurality of cavities are arranged extending through said block, some of said cavities arranged into a first cavity array and the remaining ones of said cavities forming a second cavity array, an outer conductor disposed at predetermined places on outer surfaces of the dielectric block, and inner conductors respectively disposed on surfaces of the corresponding cavities so as to define a corresponding plurality of dielectric resonators associated with the first cavity array and the second cavity array, respectively;

said dielectric resonators of said first cavity array being coupled to one another to define a band pass filter portion comprising said plurality of resonators of said first cavity array; and a second plurality of stages of resonators are defined by said resonators of said second cavity array;

respective ones of said resonators of said second cavity array and said band pass filter portion being coupled to each other;

wherein:

a first opening portion of each inner conductor of said first array is electrically short-circuited to said outer conductor, an opposite second opening portion thereof being electrically open-circuited and a tip capacitance being provided between said outer conductor and said second opening portion so that said plurality of resonators of said first array are combline-coupled to one another to define said band pass filter portion; and a first opening portion and a second opening portion of each inner conductor of said second cavity array are both electrically short-circuited to said outer conductor.

8. The dielectric filter as claimed in claim 7, wherein each of said resonators of said second cavity array has a respective cross-sectional shape which is elongated in a plane defined by said second cavity array.

9. The dielectric filter as claimed in claim 7, wherein each of said resonators of said first cavity array has a respective cross-sectional shape which is elongated in a plane defined by said first cavity array.

10. The dielectric filter as claimed in claim 9, wherein each of said resonators of said second cavity array has a respective cross-sectional shape which is elongated in a plane defined by said second cavity array.

11. The dielectric filter as claimed in claim 7, wherein each of said resonators of said first cavity array has a respective cross-sectional diameter at one of said first and second opening portions which is greater than a respective cross-sectional diameter at the other of said first and second opening portions.

12. The dielectric filter as claimed in claim 11, wherein each said greater cross-sectional diameter is at a respective said open-circuited first opening portion.

* * * * *